US007080007B2

(12) United States Patent
Son et al.

(10) Patent No.: US 7,080,007 B2
(45) Date of Patent: Jul. 18, 2006

(54) APPARATUS AND METHOD FOR COMPUTING SPEECH ABSENCE PROBABILITY, AND APPARATUS AND METHOD REMOVING NOISE USING COMPUTATION APPARATUS AND METHOD

(75) Inventors: Chang-yong Son, Seoul (KR); Vladimir Shin, Kyungki-do (KR); Sang-ryong Kim, Kyungki-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 764 days.

(21) Appl. No.: 10/253,418

(22) Filed: Sep. 25, 2002

(65) Prior Publication Data

US 2003/0101055 A1 May 29, 2003

(30) Foreign Application Priority Data

Oct. 15, 2001 (KR) ..... 2001-63404

(51) Int. Cl.
*G10L 11/02* (2006.01)

(52) U.S. Cl. ..... 704/210; 704/215; 704/226

(58) Field of Classification Search ..... None
See application file for complete search history.

(56) References Cited

U.S. PATENT DOCUMENTS 6,678,657 B1 * 1/2004 Bruckner et al. ..... 704/240
6,778,954 B1 * 8/2004 Kim et al. ..... 704/226

FOREIGN PATENT DOCUMENTS

KR 2001-0019603 3/2001

OTHER PUBLICATIONS

Vladimir Shin et al., "Enhancement of Noisy Speech by Using Improved Global Soft Decision," *Proc. European Conf. on Speech Communication and Technology (Eurospeech)*, vol. 3, Sep 3-7, 2001 pp. 1929-1932.

(Continued)

*Primary Examiner*—David D. Knepper
(74) *Attorney, Agent, or Firm*—Buchanan Ingersoll PC

(57) ABSTRACT

An apparatus and a method for computing a Speech Absence Probability (SAP), and an apparatus and a method for removing noise by using the SAP computing device and method are provided. The provided SAP computing device for computing the SAP indicating probability that speech is absent in a $m^{th}$ frame, from a first through $Nc^{th}$ posteriori (Nc means the total number of channels) Signal to Noise Ratios (SNR) calculated with regard to the $m^{th}$ frame of a speech signal and a first through $Nc^{th}$ predicted SNRs predicted with regard to the $m^{th}$ frame, includes: a first through $Nc^{th}$ likelihood ratio generators for generating a first through $Nc^{th}$ likelihood ratios from the first through $Nc^{th}$ posterior SNRs and the first through $Nc^{th}$ predicted SNRs, and outputting them; a first multiplying unit for multiplying the first through $Nc^{th}$ likelihood ratios by a predetermined a priori probability, and outputting the multiplication results; an adding unit for adding each of the multiplication results received from the first multiplying unit to a predetermined value, and outputting the added results; a second multiplying unit for multiplying the added results received from the adding unit and outputting the multiplication result; and a inverse number calculator for calculating inverse number of the multiplication result received from the second multiplying unit and outputting the calculated inverse number as the SAP. Therefore, since the accuracy of the calculated SAP is high, noise can be efficiently removed from the speech signal that may have noise and an enhanced speech signal with an enhanced quality can be provided.

4 Claims, 4 Drawing Sheets

OTHER PUBLICATIONS

Nam Soo Kim et al., "Spectral Enhancement Based on Global Soft Decision," *IEEE Signal Processing Letters*, May 2000, vol. 7, No. 5, pp. 108-110.

Robert J. McAulay and Marilyn L. Malpass, "Speech Enhancement Using a Soft-Decision Noise Suppression Filter", *IEEE Transactions on Accoustics, Speech, And Signal Processing*, vol ASSP-28, No. 2, Apr. 1980, pp. 137-145.

Jae S. Lim and Alan V. Oppenheim, "Enhancement and Bandwidth Compression of Noisy Speech", *Proceedings of the IEEE*, vol. 67, No. 12, Dec. 1979, pp. 1586-1604.

Oliver Cappé, "Elimination of the Musical Noise Phenomenon with the Ephraim and Malah Noise Suppressor", *IEEE Transactions on Speech and Audio Processing*, vol. 2, No. 2, Apr. 1994, pp. 345-349.

Kim, N. et al., *Spectral Enhancement Based on Global Soft Decision*, IEEE Signal Processing Letters, vol. 7, No. 5, May 2000, pp. 108-110.

Ephraim, Y. et al., *Speech Enhancement using a Minimum Mean-Square Error Short-Time Spectral Amplitude Estimator*, IEEE Transactions on Acoustics, Speech, and IEEE Signal Proceesing, vol. ASSP-32, No. 6, Dec. 1984, pp. 1109-1121.

* cited by examiner

APPARATUS AND METHOD FOR COMPUTING SPEECH ABSENCE PROBABILITY, AND APPARATUS AND METHOD REMOVING NOISE USING COMPUTATION APPARATUS AND METHOD

BACKGROUND OF THE INVENTION

This application is based upon and claims priority from Korean Patent Application No. 2001-63404 filed Oct. 15, 2001, the contents of which are incorporated herein by reference.

1. Field of the Invention

The present invention relates to a speech signal processing, and more particularly, to an apparatus and a method for computing a Speech Absence Probability (SAP), and an apparatus and a method for removing noise that exists in a speech by using the computation apparatus and method.

2. Description of the Related Art

SAP refers to the probability that speech is absent in a given speech period, and is a basis for determining whether the speech is absent or not in the section. In the section deemed to have no speech, it is considered that only noise exists while in the section deemed to have only noise, variance of the noise is updated. Since the dispersion of the noise has a great influence on the performance of a noise removal device, more accurate computation of the SAP helps to remove the noise effectively.

Speech enhancement refers to the activity of improving the system performance that is, minimizing impact of the noise that deteriorates the system performance when an input signal or an output signal of a speech communication system is contaminated by noise. The speech enhancement is necessary for a human-to-human communication or a human-to-machine communication when a communication channel is influenced by noise, or a receiving end detects noise. Especially, the speech enhancement is required when an input speech signal contaminated by the noise is coded, the performance of the speech recognition system needs to be improved and the quality of speech needs to be improved. Generally, the speech enhancement refers to the activity of assuming a noise-free speech signal in a noise speech environment where a speech absence is uncertain. The concept of using uncertainty of speech absence that exists in each frequency channel of a noise speech spectrum has been applied to enhancement of performance of a speech enhancement system. The concept of using uncertainty of speech absence is disclosed in a thesis on pages 1109–1121 of IEEE Transactions on Acoustics, Speech, and Signal Processing, Vol. ASSP-32, No. 6, which was publicized in 1984 by Yariv Ephraim and David Malah under the title of "Speech Enhancement using a Minimum Mean-Square Error Short-Time Spectral Amplitude Estimator". According to a conventional method for computing the SAP shown in most studies, the SAP of each frequency channel was computed locally irrespective of other frequency channels. However, the conventional computation method has limit in guaranteeing statistical reliability when speech enhancement is realized because insufficient data is used.

As another solution to the above problem, there is a Global Soft Decision (GSD) disclosed in a thesis on pages 108–110 of IEEE Signal Processing Letters, Vol. 7, which was publicized by N. Kim and J. Chang in 2000, under the title of "Spectral enhancement based on global soft decision". The conventional GSD proved to be superior to the method used in IS-127 standard. The GSD uses data of all the frequency channels, determines globally whether a given time frame is a speech absence frame or not, and uses sufficient amounts of data. Therefore, the statistical reliability of the GSD can be higher than that of the method for computing the SAP. In addition, since the conventional GSD assumes a noise power spectrum from noise speech in not only the speech absence frame but also speech presence frame unlike the conventional other methods, the SAP can be computed more accurately, and a robust procedure for spectral gain modification and noise spectrum estimation can be provided. One of the conventional GSD methods is disclosed under the title of 'Speech Enhancement Method' in Korean Patent No. 99-36115. However, the conventional GSD method is based on an inaccurate assumption that spectrum components of each frequency channel are independent. As a result, the SAP cannot be computed accurately and noise cannot be removed effectively under the noise environment.

SUMMARY OF THE INVENTION

To solve the above-described problems, it is a first object of the present invention to provide a Speech Absence Probability (SAP) computing device that is used to detect a noise section effectively in each frequency band and can compute the SAP accurately that indicates the probability that speech is absent.

It is a second object of the present invention to provide an SAP computing method for accurately computing the SAP that is used to detect the noise section effectively in each frequency band and indicates the probability that speech is absent.

It is a third object of the present invention to provide a noise removing device which uses the SAP computing device and can efficiently remove the noise included in a speech by using the SAP that indicates the probability that speech is absent.

It is a fourth object of the present invention to provide a method for removing noise in the noise removing device.

To accomplish the first object of the present invention, an SAP computing device for computing the SAP indicating-probability that speech is absent in a $m^{th}$ frame, from a first through $Nc^{th}$ posteriori (Nc means the total number of channels) Signal to Noise Ratios (SNR) calculated with regard to the $m^{th}$ frame of a speech signal and a first through $Nc^{th}$ predicted SNRs predicted with regard to the $m^{th}$ frame, comprises: a first through $Nc^{th}$ likelihood ratio generators for generating a first through $Nc^{th}$ likelihood ratios from the first through $Nc^{th}$ posterior SNRs and the first through $Nc^{th}$ predicted SNRs, and outputting them; a first multiplying unit for multiplying the first through $Nc^{th}$ likelihood ratios by a predetermined a priori probability, and outputting the multiplication results; an adding unit for adding each of the multiplication results received from the first multiplying unit to a predetermined value, and outputting the added results; a second multiplying unit for multiplying the added results received from the adding unit and outputting the multiplication result; and a inverse number calculator for calculating inverse number of the multiplication result received from the second multiplying unit and outputting the calculated inverse number as the SAP.

To accomplish the second object of the present invention, an SAP computing method for computing the SAP indicating probability that speech is absent in a $m^{th}$ frame, from a first through $Nc^{th}$ posteriori (Nc means the total number of channels) Signal to Noise Ratios (SNR) calculated with regard to the $m^{th}$ frame of a speech signal and a first through $Nc^{th}$ predicted SNRs predicted with regard to the $m^{th}$ frame, comprises: (a) generating the first through $Nc^{th}$ likelihood ratios from the first through $Nc^{th}$ posterior SNRs and the first through $Nc^{th}$ predicted SNRs; (b) multiplying the first through $Nc^{th}$ likelihood ratios by a predetermined priori probability; (c) adding each of the multiplication results to the predetermined value; (d) multiplying the added results; and (e) calculating the inverse number of the result multiplied in step (d) and determining the calculated inverse number as the SAP.

To accomplish the third object of the present invention, an apparatus for removing noise from a speech signal using an SAP computed from posteriori Signal to Noise Ratios (SNR) calculated with regard to a $m^{th}$ frame of the speech signal and predicted SNRs predicted with regard to the $m^{th}$ frame, and indicating probability that speech is absent in the $m^{th}$ frame, comprises: a posterior SNR calculator for calculating the posterior SNRs of the speech signal by frame, which is pre-processed in a time area and then converted into a frequency area, and can include noise, and outputting the calculated posterior SNRs; an SNR modifier for modifying pri SNRs and the posterior SNRs from the SAP, the posterior SNRs and previous SNRs, and outputting the modified pri SNRs and the modified posterior SNRs; a gain calculator for calculating a gain to be applied to each frequency channel from the modified pri SNRs and the modified posterior SNRs, and outputting the calculated gain; a third multiplying unit for multiplying the speech signal and the gain, and outputting the multiplied result as noise-free result of the speech signal; a previous SNR calculator for calculating the previous SNRs from an estimated value of noise power and the multiplication result received from the third multiplying unit, and outputting the calculated previous SNRs to the SNR modifier; a speech/noise power updater for calculating an estimated value of the noise power and the estimated value of speech power from the speech signal, the SAP and the predicted SNRs; and an SNR predicting unit for calculating the predicted SNRs from the estimated values of the speech power and the noise power, and outputting the calculated predicted SNRs to the speech/noise power updater.

To accomplish the fourth object of the present invention, a method for removing noise from a speech signal using an SAP computed from posteriori Signal to Noise Ratios (SNR) calculated with regard to a $m^{th}$ frame of the speech signal and predicted SNRs predicted with regard to the $m^{th}$ frame, and indicating probability that speech is absent in the $m^{th}$ frame, comprises: (f) obtaining the posterior SNRs of the speech signal by frame; (g) modifying pri SNRs and the posterior SNRs by using the SAP, the posterior SNRs, and previous SNRs and deciding the modified results as the modified pri SNRs and the modified posterior SNRs; (h) obtaining a gain to be applied to each frequency channel by using the modified pri SNRs and the modified posterior SNRs; (i) multiplying the speech signal and the gain; (j) obtaining the previous SNRs by using estimated value of noise power and the result multiplied in step (i); (k) obtaining the estimated values of the noise power and speech power by using the speech signal, the SAP and the predicted SNRs; and (l) obtaining the predicted SNRs by using the estimated values of the speech power and the noise power.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

The constitution and operation of a Speech Absence Probability (SAP) computing device and a method of computing SAP in the SAP computing device according to the present invention will now be described in detail by describing preferred embodiments thereof with reference to the accompanying drawings.

Figure 1:
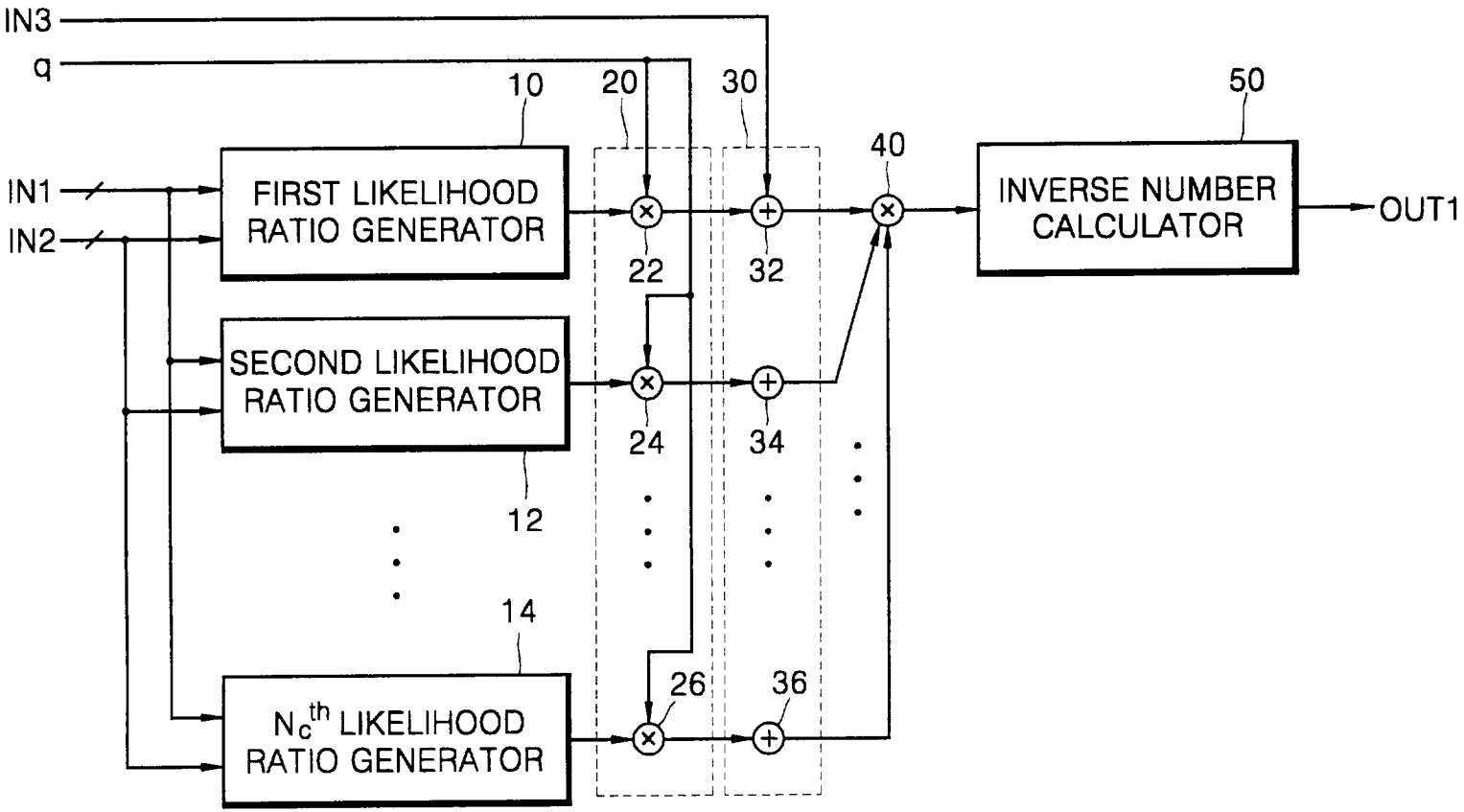
FIG. 1 is a block diagram of a Speech Absence Probability (SAP) computing device according to the present invention.

FIG. 1 is a block diagram of an SAP computing device according to the present invention. The SAP computing device includes a first through an $Nc^{th}$ likelihood ratio generators (10, 12, . . . and 14), a first multiplying unit 20, an adding unit 30, a second multiplying unit 40 and an inverse number calculator 50.

Figure 2:
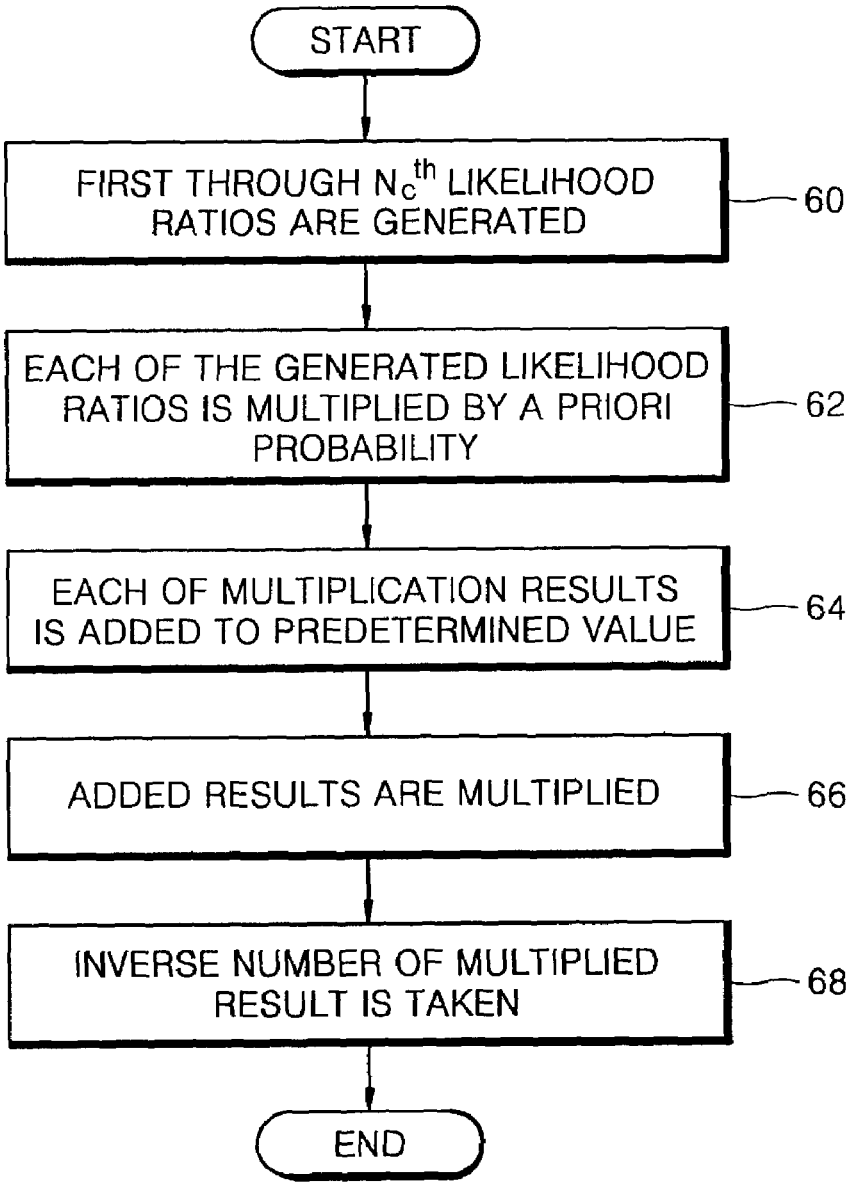
FIG. 2 is a flowchart explaining the SAP computing method, according to the invention, performed in the SAP computing device shown in FIG. 1.

FIG. 2 is a flowchart explaining the SAP computing method, according to the invention, performed in the SAP computing device shown in FIG. 1. The SAP computation method includes multiplying each of generated likelihood ratios by a priori probability (steps 60 and 62), and adding the multiplication results to a predetermined value, and multiplying the added results each other and taking inverse numbers (steps 64, 66 and 68).

The first through $Nc^{th}$ likelihood ratio generators (10, 12, . . . and 14) generate a first through an $Nc^{th}$ likelihood ratios from a first through an $Nc^{th}$ posteriori (Nc means the total number of channels included in each frame.) Signal to Noise Ratio (SNR) calculated with regard to a $m^{th}$ frame, and a first through an $Nc^{th}$ predicted SNRs predicted with regard to the $m^{th}$ frame in step 60. To do so, the first through $Nc^{th}$ likelihood ratio generators (10, 12, . . . and 14) shown in FIG. 1 generate the first through $Nc^{th}$ likelihood ratios from the first through $Nc^{th}$ posterior SNRs inputted through the input terminal (IN1) and the first through $Nc^{th}$ predicted SNRs inputted through the input terminal (IN2), and output the generated first through $Nc^{th}$ likelihood ratios to the first multiplying unit 20. For example, an $i^{th}$ ($1 \leqq i \leqq Nc$) likelihood ratio generator (10, 12, . . . or 14) calculates the likelihood ratio $[\Lambda_m(i)(G_m(i))]$ indicated in Formula 3 by using the $i^{th}$ posterior SNR$[\xi_{post}]$, which is inputted through the input terminal (IN1) and indicated in Formula 1, and the $i^{th}$ predicted SNR$[\xi_{pred}]$, which is inputted through the input terminal (IN2) and indicated in Formula 2.

$$\xi_{post}(m, i) = \eta_m(i) = \frac{|G_m(i)|^2}{\hat{\lambda}_{n,m}(i)} - 1, \qquad \text{[Formula 1]}$$

$$G_m(i) = S_m(i) + N_m(i)$$

Here, $G_m(i)$ indicates a spectrum of a signal that exists on the $i^{th}$ channel of the $m^{th}$ frame. $S_m(i)$ and $N_m(i)$ indicate a speech spectrum and a noise spectrum respectively. $\hat{\lambda}_{n,m}(i)$ indicates an estimated value of a noise power on the $i^{th}$ channel of the $m^{th}$ frame.

$$\xi_{prod}(m, i) = \xi_m(i) = \frac{\hat{\lambda}_{s,m}(i)}{\hat{\lambda}_{n,m}(i)} \quad \text{[Formula 2]}$$

$\hat{\lambda}_{s,m}(i)$ indicates an estimated value of a speech power of the $i^{th}$ channel of the $m^{th}$ frame.

$$\Lambda_m(i)(G_m(i)) = \frac{1}{1+\xi_m(i)}\exp\left[\frac{(\eta_m(i)+1)\xi_m(i)}{1+\xi_m(i)}\right] \quad \text{[Formula 3]}$$

After the step 60, the first multiplying unit 20 multiplies the first through $Nc^{th}$ likelihood ratios received from the first through $Nc^{th}$ likelihood ratio generators (10, 12, . . . and 14) by a predetermined a priori probability (q) as indicated in Formula 4, and outputs the multiplication results to the adding unit 30 in step 62.

$$q = \frac{p(H_1)}{p(H_0)} \quad \text{[Formula 4]}$$

Here, p ($H^1$) indicates the probability that noise and speech coexist and p ($H_0$) indicates the probability that only noise exists. To perform the step 62, the first multiplying unit 20 includes Nc multipliers (22, 24, . . . and 26). The $i^{th}$ multiplier (22, 24, . . . or 26) multiplies the likelihood ratio $[\Lambda_m(i)(G_m(i))]$ received from the $i^{th}$ likelihood ratio generator (10, 12, . . . or 14) by the a priori probability (q), and outputs the multiplication results to the adding unit 30.

After the step 62, the adding unit 30 adds each of the multiplication results $[q\Lambda_m(1)(G_m(1)), q\Lambda_m(2)(G_m(2)), \ldots$ and $q\Lambda_m(Nc)(G_m(Nc))]$ received from the first multiplying unit 20 to a predetermined value received through the input terminal (IN3), for example, '1', and then outputs the added results to the second multiplying unit 40 in step 64. For this, the adding unit 30 includes a first through $Nc^{th}$ adders (32, 34, . . . and 36). The $i^{th}$ adder (32, 34, . . . or 36) adds the multiplication result $[q\Lambda_m(i)(G_m(i))]$ received from the $i^{th}$ multiplier (22, 24, . . . or 26) to '1', and then outputs the added result to the second multiplying unit 40.

After the step 64, the second multiplying unit 40 multiplies the added results received from the adding unit 30 and outputs the multiplication result to the inverse number calculator 50 in step 66. After the step 66, the inverse number calculator 50 calculates the inverse number of the multiplication result received from the second multiplying unit 40 and outputs the calculated inverse number through the output terminal (OUT1) as the SAP $[p(H_o|G(m))$ which is the probability that speech is absent in the $m^{th}$ frame in step 68.

As a result, the SAP $[p(H_o|G(m))$ calculated in the conventional method is calculated as shown in Formula 5 on the assumption that $G_m(1)$, $G_m(2)$, . . . and $G_m(Nc)$ are independent, that is, spectrum components of each frequency channel are independent.

$$\begin{aligned} p(H_O \mid G(m)) &= \frac{p(H_O, G(m))}{p(G(m))} \\ &= \frac{p(G(m) \mid H_O)p(H_O)}{p(G(m) \mid H_O)p(H_0) + p(G(m) \mid H_1)p(H_1)} \\ &= \frac{p(H_O)\prod_{i=1}^{N_c} p(G_m(i) \mid H_O)}{p(H_O)\prod_{i=1}^{N_c} p(G_m(i) \mid H_O) + p(H_1)\prod_{i=1}^{N_c} p(G_m(i) \mid H_1)} \\ &= \frac{1}{1 + q\prod_{i=1}^{N_c}[\Lambda_m(i)(G_m(i))]} \end{aligned} \quad \text{[Formula 5]}$$

Here, G(m) is a vector that indicates spectrum components of the $m^{th}$ frame and is indicated as shown in Formula 6. $p(G_m(i)|H_o)$ and $p(G_m(i)|H_1)$ are indicated as shown in Formula 7.

$$G(m) = \begin{bmatrix} G_m(1) \\ G_m(2) \\ \vdots \\ G_m(N_c) \end{bmatrix} \quad \text{[Formula 6]}$$

$$\begin{aligned} p(G_m(i) \mid H_O) &= \frac{1}{\pi\lambda_{n,m}(i)}\exp\left[-\frac{|G_m(i)|^2}{\lambda_{n,m}(i)}\right] \\ p(G_m(i) \mid H_1) &= \frac{1}{\pi(\lambda_{n,m}(i) + \lambda_{s,m}(i))} \\ &\quad \exp\left[-\frac{|G_m(i)|^2}{\lambda_{n,m}(i) + \lambda_{s,m}(i)}\right] \end{aligned} \quad \text{[Formula 7]}$$

$\lambda_{n,m}(i)$ and $\lambda_{s,m}(i)$ indicate noise power and speech power of the $i^{th}$ channel in the $m^{th}$ frame respectively.

The SAP $[p(H_o|G(m))$ calculated according to the present invention is calculated in Formula 8 because whether or not speech is absent can independently be considered in each channel of the $m^{th}$ frame.

$$p(H_O \mid G(m)) = \frac{p(H_O, G(m))}{p(G(m))} = \frac{\prod_{i=1}^{N_c} [p(G_m(i) \mid H_O)p(H_O)]}{\prod_{i=1}^{N_c} p(G_m(i))} = \frac{\prod_{i=1}^{N_c} p(G_m(i) \mid H_O)p(H_O)}{\prod_{i=1}^{N_c} [p(G_m(i) \mid H_O)p(H_O) + p(G_m(i) \mid H_1)p(H_1)]} = \frac{1}{\prod_{i=1}^{N_c} [1 + q\Lambda_m(i)(G_m(i))]}$$ [Formula 8]

The configuration and operation of the noise removing device according to the present invention, which uses the apparatus and the method for computing the SAP, and the method of the noise removal according to the invention performed by the noise removing device will be described with reference to accompanying drawings.

Figure 3:
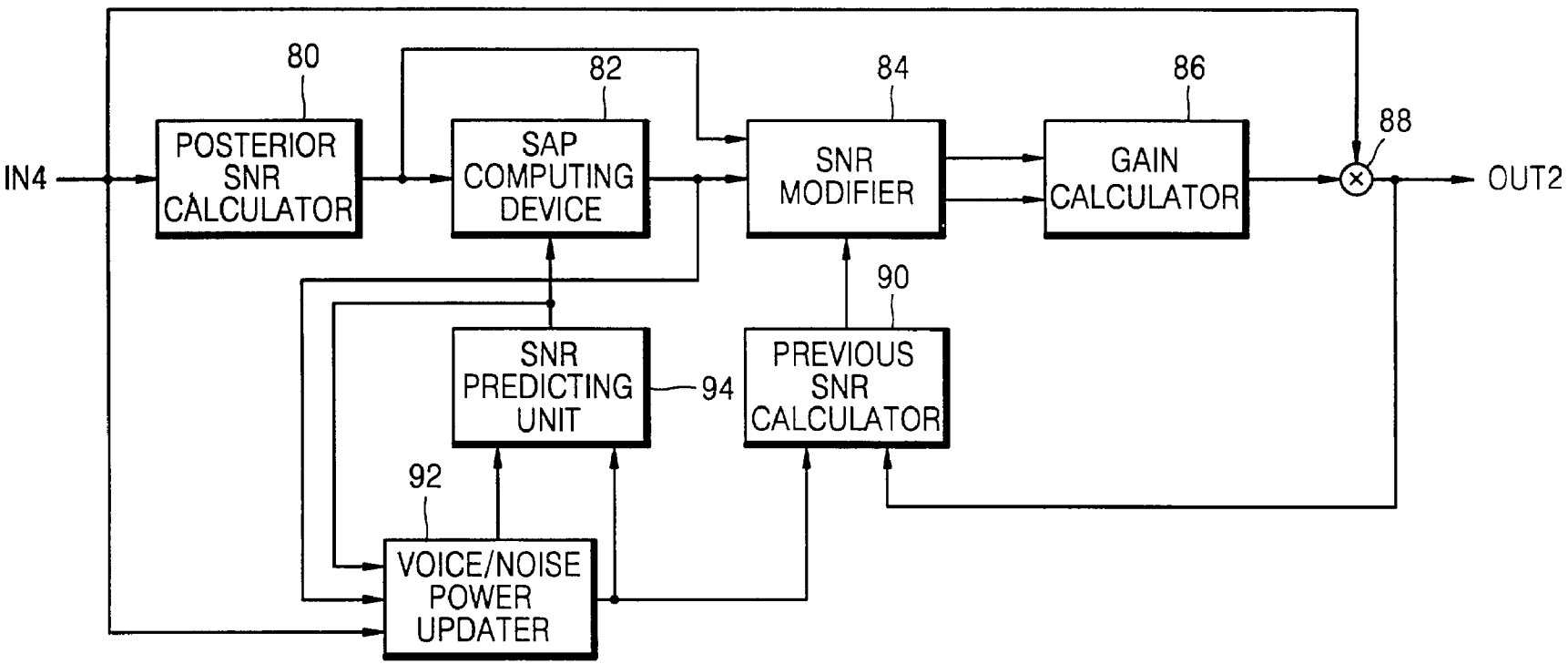
FIG. 3 is a block diagram of a noise removing device according to the present invention which uses the SAP computing device shown in FIG. 1.

FIG. 3 is a block diagram of the noise removing device according to the present invention which uses the SAP computing device shown in FIG. 1. The noise removing device includes a posterior SNR calculator 80, an SAP computing device 82, an SNR modifier 84, a gain calculator 86, a third multiplying unit 88, a previous SNR calculator 90, a speech/noise power updater 92 and an SNR predicting unit 94.

Figure 4:
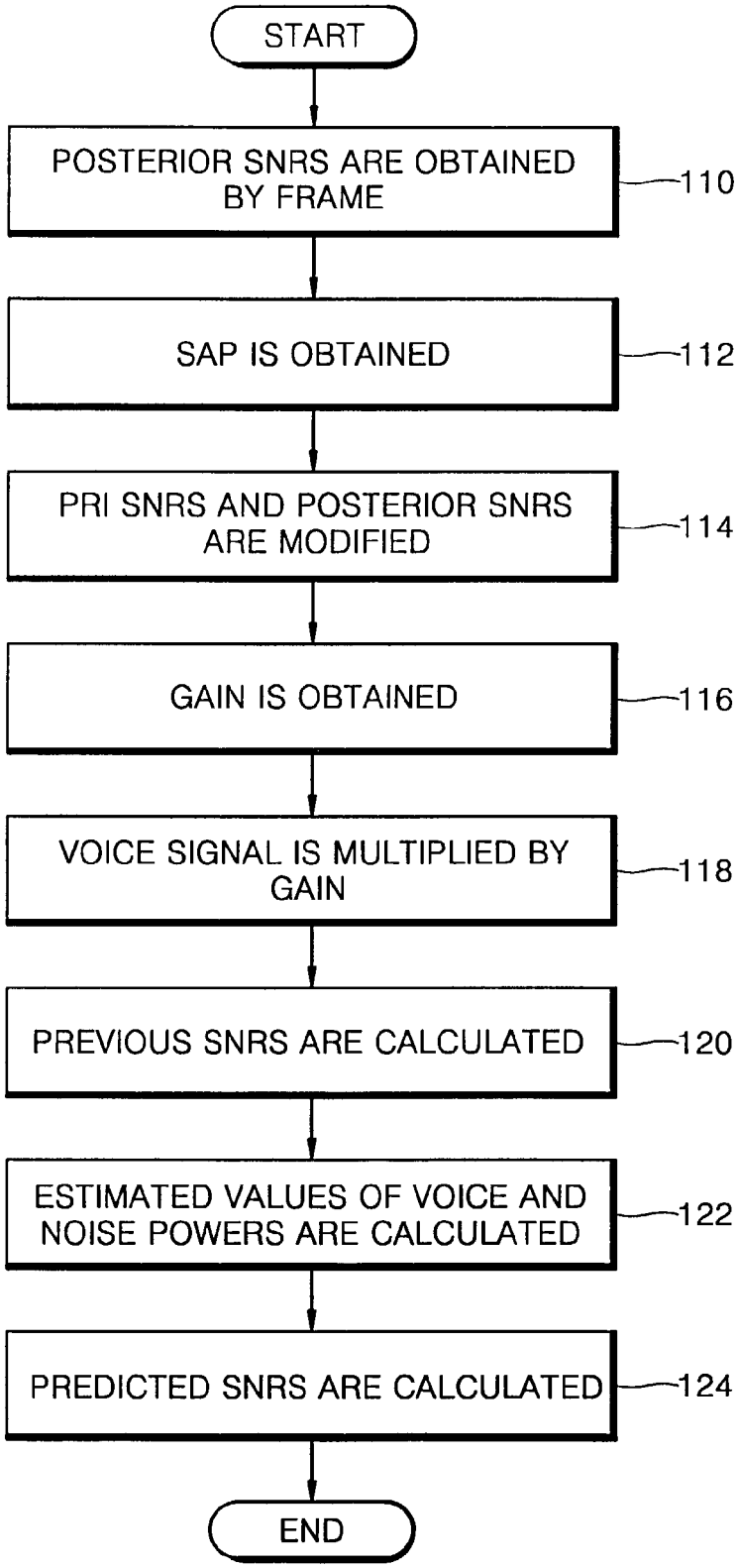
FIG. 4 is a flowchart explaining the noise removing method according to the present invention performed in the noise removing device shown in FIG. 3.

FIG. 4 is a flowchart explaining the noise removing method according to the present invention performed in the noise removing device shown in FIG. 3. The noise removing method includes: steps 110 and 112 of obtaining the SAP by using the posterior SNRs and predicted SNRs; steps 114 and 116 of obtaining a gain by using the modified pri SNRs and the modified posterior SNRs; steps 118 and 120 of multiplying a speech signal and the gain, and obtaining a previous SNR; and steps 122 and 124 of obtaining estimated values of speech power and noise power, and predicted SNRs.

In step 110, the posterior SNR calculator 80 calculates posterior SNRs by frame of a speech signal which is pre-processed in a time area and then converted into a frequency area and can include noise, and then progresses to step 60. To do so, the posterior SNR calculator 80 shown in FIG. 3 can have noise, calculate Nc posterior SNRs of each frame of the speech signal inputted through the input terminal (IN4) from the pre-processor (not shown), and then outputs the calculated posterior SNRs to the SAP computing device 82. The pre-processor (not shown) pre-emphasizes the speech signal mixed with the noise and performs M-point Fast Fourier Transform. For example, the posterior SNR calculator 80 calculates the $i^{th}$ post SNR[$\xi_{post}$(m,i)], which is one of the first through $Nc^{th}$ posterior SNRs with regard to the $m^{th}$ frame, as shown in Formula 9.

$$\xi_{post}(m, i) = \max\left[\frac{E_{acc}(m, i)}{\hat{\lambda}_{n,m}(i)} - 1, SNR_{\mathrm{MIN}}\right]$$ [Formula 9]

When correlation between frames of the speech signal is considered, the $E_{acc}$(m,i) is indicated in Formula 10 as the power of the smoothed speech signal. $SNR_{MIN}$ is the minimum value of the posterior SNR predetermined by a user.

$$E_{acc}(m,i)=\xi_{acc}E_{acc}(m-1,i)+(1-\xi_{acc})|G_m(i)|^2$$ [Formula 10]

Here, $\xi_{acc}$ indicates a smoothed parameter.

After the step 110, the SAP computing device 82 computes the SAP as described above using Nc posterior SNRs and Nc predicted SNRs in step 112. The SAP computing device 82 shown in FIG. 3 corresponds to the SAP computing device shown in FIG. 1 and has the same configuration and function as that of FIG. 1. The step 112 shown in FIG. 4 is the same as the method of computing the SAP shown in FIG. 2. Therefore, detailed explanation of the SAP computing device 82 and the step 112 will be omitted.

After the step 112, the SNR modifier 84 modifies pri SNRs [$\xi_{pri}$(m,i)] and posterior SNRs [$\xi_{post}$(m,i)] by using the SAP [$p(H_o|G_m(i))$ received from the SAP computing device 82 shown in FIG. 1 or 3, posterior SNRs [$\xi_{post}$(m,i)] received from the posterior SNR calculator 80 and previous SNRs [$\xi_{prev}$(m,i)] calculated by the previous SNR calculator 90 with regard to the previous frame. Then, the SNR modifier 84 outputs the modified pri SNRs [$\xi'_{pri}$(m,i)] and the modified posterior SNRs [$\xi'_{post}$(m,i)] as indicated in Formula 11 to the gain calculator 86 in step 114.

$$\xi'_{pri}(m,i)=max\{p(H_0|G_m)SNR_{MIN}+p(H_1|G_m)\xi_{pri}(m,i), SNR_{MIN}\}$$

$$\xi'_{post}(m,i)=max\{p(H_0|G_m)SNR_{MIN}+p(H_1|G_m)\xi_{post}(m,i), SNR_{MIN}\}$$ [Formula 11]

The pri SNR[$\xi_{pri}$(m,i)] is calculated as shown in Formula 12 in a Decision-Directed (DD) method.

$$\xi_{pri}(m,i)=\alpha\xi_{prev}(m,i)+(1-\alpha)\xi_{post}(m,i)$$ [Formula 12]

The pri SNR [$\xi_{prev}$(m,i)] is indicated as shown in Formula 13.

$$\xi_{prev}(m, i) = \frac{|\hat{S}_{m-1}(i)|^2}{\lambda_{n,m-1}(i)} = \frac{|H(m-1, i)G_{m-1}(i)|^2}{\hat{\lambda}_{n,m-1}(i)}$$ [Formula 13]

$|\hat{S}_{m-1}(i)|^2$ indicates an estimated value of the speech power in the m−1th frame.

After the step 114, the gain calculator 86 calculates the gain [H(m,i)] to be applied to each frequency channel from the modified pri SNRs [$\xi'_{pri}$(m,i)] and the modified posterior SNRs [$\xi'_{post}$(m,i)] received from the SNR modifier 84 as shown in Formula 14, and outputs the calculated gain [H(m,i)] to the third multiplying unit 88 in step 118.

$$H(m, i) = \Gamma(1.5)\frac{\sqrt{v_m(i)}}{\gamma_m(i)}\exp\left(-\frac{v_m(i)}{2}\right)\left[(1+v_m(i))I_0\frac{v_m(i)}{2}+v_m(i)I_1\frac{v_m(i)}{2}\right] \quad \text{[Formula 14]}$$

$\gamma_m(i)$ and $v_m(i)$ are shown in Formula 15. $I_0$ means a modified Bessel function of zero order, and $I_1$ means a modified Bessel function of first order.

$$\gamma_m(i) = \xi'_{post}(m, i) + 1 \quad \text{[Formula 15]}$$

$$v_m(i) = \frac{\xi'_{pri}(m, i)}{1+\xi'_{pri}(m, i)}(1+\xi'_{post}(m, i))$$

After the step 116, the third multiplying unit 88 multiplies the speech signal [G(m)] and the gain [H(m)] inputted through the input terminal (IN4), and outputs the multiplication result [G(m)H(m)] through the output terminal (OUT2) to the processor (not shown) as an enhanced speech signal whose noise is removed in step 118. The post-processor (not shown) performs IFFT of the enhanced speech signal and de-emphasis on the result of IFFT.

After the step 118, the previous SNR calculator 90 calculates the previous SNRs[$\xi_{prev}$(m+1,i)] indicated in Formula 13 by using the estimated value [$\hat{\lambda}_{n,m}(i)$] of the noise power with regard to the $m^{th}$ frame and the multiplication result [$|\hat{S}_m(1)|^2$] received from the third multiplying unit 88, and then, outputs the calculated previous SNRs [$\xi_{prev}$(m+1, i)] to the SNR modifier 84 in step 120.

After the step 120, the speech/noise power updater 92 calculates the estimated values of the noise power and the speech power from the speech signal [G(m)] inputted through the input terminal (IN4), the SAP transmitted by the SAP computing device 82 and the predicted SNRs transmitted by the SNR predicting unit 94 in step 122. For example, the speech/noise power updater 92 calculates the estimated value [$\hat{\lambda}_{n,m+1}(i)$] of the noise power with regard to the m+1th frame as shown in Formula 16.

$$\hat{\lambda}_{n,m+1}(i)=\xi_n\hat{\lambda}_{n,m}(i)+(1-\xi_n)E[|N_m(i)|^2|G_m(i)] \quad \text{[Formula 16]}$$

$\xi_n$ indicates a smoothed parameter. When Gm(i) is given, $E[|N_m(i)|^2|G_m(i)]$ can be calculated as the estimated value of the noise power in accordance with the GSD method in Formula 17.

$$E[|N_m(i)|^2|G_m(i)]=E[|N_m(i)|^2|G_m(i),H_0]p(H_0|G_m)+E[|N_m(i)|^2|G_m(i),H_1]p(H_1|G_m) \quad \text{[Formula 17]}$$

$E[|N_m(i)|^2|G_m(i), H_0]$ is $|G_m(i)|^2$, and $E[|N_m(i)|^2|G_m(i), H_1]$ is shown in Formula 18.

$$E[|N_m(i)|^2 \mid G_m(i), H_1] = \left(\frac{\xi_{pred}(m, i)}{1+\xi_{pred}(m, i)}\right)\hat{\lambda}_{n,m}(i)+\left(\frac{1}{1+\xi_{pred}(m, i)}\right)^2|G_m(i)|^2 \quad \text{[Formula 18]}$$

The speech/noise power updater 92 calculates the estimated value [$\hat{\lambda}_{s,m+1}(i)$] of the speech power with regard to the m+1th frame in Formula 19.

$$\hat{\lambda}_{s,m+1}(i)=\xi_{s,m}(i)+(1-\xi_s)E[|S_m(i)|^2|G_m(i)] \quad \text{[Formula 19]}$$

$\xi_s$ indicates a smoothed parameter. When $G_m(i)$ is given, $E[|S_m(i)|^2|G_m(i)]$ can be calculated as the estimated value of the speech power in accordance with the GSD method in Formula 20.

$$E[|S_m(i)|^2|G_m(i)]=E[|S_m(i)|^2|G_m(i),H_1]p(H_1|G_m)+E[|S_m(i)|^2|G_m(i),H_0]p(H_0|G_m) \quad \text{[Formula 20]}$$

$E[|S_m(i)|^2|G_m(i), H_0]$ is 'O', and $E[|S_m(i)|^2|G_m(i), H_1]$ is indicated as shown in Formula 21.

$$E[|S_m(i)|^2 \mid G_m(i), H_1] = \left(\frac{1}{1+\xi_{pred}(m, i)}\right)\hat{\lambda}_{s,m}(i)+\left(\frac{\xi_{pred}(m, i)}{1+\xi_{pred}(m, i)}\right)^2|G_m(i)|^2 \quad \text{[Formula 21]}$$

As shown in Formulas 18 and 21, the speech/noise power updater 92 saves the estimated values of speech and noise powers of the $m^{th}$ frame in order to calculate the estimated values of the speech power and the noise power of the m+1th frame.

After the step 122, the SNR predicting unit 94 calculates predicted SNRs from the estimated values of the speech power and the noise power received from the speech/noise power updater 92, and outputs the calculated predicted SNRs to the SAP computing device 82 and the speech/noise power updater 92 respectively in step 124. For example, the SNR predicting unit 94 calculates the predicted SNR[$\xi_{pred}$(m+1,i)] of the $i^{th}$ channel with regard to m+1th frame by using the estimated value [$\hat{\lambda}_{s,m+1}(i)$] of the $i^{th}$ speech power and the estimated value [$\hat{\lambda}_{n,m+1}(i)$] of the $i^{th}$ noise power with regard to m+1th frame as shown in Formula 22.

$$\xi_{pred}(m+1, i) = \frac{\hat{\lambda}_{s,m+1}(i)}{\hat{\lambda}_{n,m+1}(i)} \quad \text{[Formula 22]}$$

The result of removing noise based on the SAP computed according to the present invention and the result of removing noise in accordance with the conventional GSD method will be compared below.

Korean speech database provided by ITU-T was used to conduct an objective and a subjective evaluation on the quality of the speech of four men and four women.

When a segmental SNR is used as the objective evaluation criterion, the result of removing noise according to the present invention provides higher SNR than the result of removing noise according to the conventional method. In addition, if the frame size is 80 samples, the total number (Nc) of frequency channels is 16, p ($H_0$) is 0.996, q is 0.004 and the sampling ratio is 8 kHz, the result of a Mean Opinion Score (MOS) conducted as the subjective evaluation criterion is shown in Table 1.

TABLE 1

| Type of noise | SNR of G(m) | When noise is not removed | When noise is removed in the conventional method | When noise is removed in the apparatus and the method according to the present invention |
|---|---|---|---|---|
| None | — | 4.47 | 4.73 | 4.70 |
| White | 10 | 1.17 | 2.17 | 2.27 |
| Gaussian | 20 | 1.41 | 3.14 | 3.38 |

TABLE 1-continued

| Type of noise | SNR of G(m) | When noise is not removed | When noise is removed in the conventional method | When noise is removed in the apparatus and the method according to the present invention |
|---|---|---|---|---|
| Babble | 10 | 2.09 | 2.73 | 2.69 |
| | 20 | 3.09 | 3.47 | 3.52 |
| Car | 10 | 2.19 | 2.67 | 2.78 |
| | 15 | 2.58 | 3.06 | 3.16 |
| | 20 | 2.92 | 3.50 | 3.61 |

The numbers listed in the three columns on the right indicate the degrees of the speech quality evaluated by the listeners in accordance with their own subjective criteria, and are indicated as 1 through 5. The higher the numbers are, the better the speech quality is deemed to be by the listeners. Except for the babble noise of 10 dB, if the white Gaussian noise, the babble noise of 20 dB and the car noise are removed by the apparatus and the method according to the present invention, better quality can be provided. Therefore, the apparatus and the method for computing the SAP according to the present invention can calculate the SAP more accurately than the conventional GSD method.

As described above, if the apparatus and the method for computing the SAP according to the present invention, and the apparatus and the method for removing noise by using the above SAP computing device and method can more accurately compute SAP when being applied to a signal processing related to the quality of the acoustic signal such as speech coding, music encoding and speech enhancement. Therefore, noise is efficiently removed from the speech signal that can have noise and the speech signal which has enhanced speech quality can be provided.

What is claimed is:

1. A Speech Absence Probability (SAP) computing device for computing the SAP indicating probability that speech is absent in a $m^{th}$ frame, from a first through $Nc^{th}$ posteriori (Nc means the total number of channels) Signal to Noise Ratios (SNR) calculated with regard to the $m^{th}$ frame of a speech signal and a first through $Nc^{th}$ predicted SNRs predicted with regard to the $m^{th}$ frame, the SAP computing device comprising:

a first through $Nc^{th}$ likelihood ratio generators for generating a first through $Nc^{th}$ likelihood ratios from the first through $Nc^{th}$ posterior SNRs and the first through $Nc^{th}$ predicted SNRs, and outputting them;

a first multiplying unit for multiplying the first through $Nc^{th}$ likelihood ratios by a predetermined a priori probability, and outputting the multiplication results;

an adding unit for adding each of the multiplication results received from the first multiplying unit to a predetermined value, and outputting the added results;

a second multiplying unit for multiplying the added results received from the adding unit and outputting the multiplication result; and a inverse number calculator for calculating inverse number of the multiplication result received from the second multiplying unit and outputting the calculated inverse number as the SAP.

2. An SAP computing method for computing the SAP indicating probability that speech is absent in a $m^{th}$ frame, from a first through $Nc^{th}$ posteriori (Nc means the total number of channels) Signal to Noise Ratios (SNR) calculated with regard to the $m^{th}$ frame of a speech signal and a first through $Nc^{th}$ predicted SNRs predicted with regard to the $m^{th}$ frame, the SAP computing method comprising:

(a) generating the first through $Nc^{th}$ likelihood ratios from the first through $Nc^{th}$ posterior SNRs and the first through $Nc^{th}$ predicted SNRs;

(b) multiplying the first through $Nc^{th}$ likelihood ratios by a predetermined priori probability;

(c) adding each of the multiplication results to the predetermined value;

(d) multiplying the added results; and (e) calculating the inverse number of the result multiplied in step (d) and determining the calculated inverse number as the SAP.

3. An apparatus for removing noise from a speech signal using an SAP computed from posteriori Signal to Noise Ratios (SNR) calculated with regard to a $m^{th}$ frame of the speech signal and predicted SNRs predicted with regard to the $m^{th}$ frame, and indicating probability that speech is absent in the $m^{th}$ frame, the noise removing device comprising:

a posterior SNR calculator for calculating the posterior SNRs of the speech signal by frame, which is preprocessed in a time area and then converted into a frequency area, and can include noise, and outputting the calculated posterior SNRs;

an SNR modifier for modifying pri SNRs and the posterior SNRs from the SAP, the posterior SNRs and previous SNRs, and outputting the modified pri SNRs and the modified posterior SNRs;

a gain calculator for calculating a gain to be applied to each frequency channel from the modified pri SNRs and the modified posterior SNRs, and outputting the calculated gain;

a third multiplying unit for multiplying the speech signal and the gain, and outputting the multiplied result as noise-free result of the speech signal;

a previous SNR calculator for calculating the previous SNRs from an estimated value of noise power and the multiplication result received from the third multiplying unit, and outputting the calculated previous SNRs to the SNR modifier;

a speech/noise power updater for calculating an estimated value of the noise power and the estimated value of speech power from the speech signal, the SAP and the predicted SNRs; and an SNR predicting unit for calculating the predicted SNRs from the estimated values of the speech power and the noise power, and outputting the calculated predicted SNRs to the speech/noise power updater.

4. A method for removing noise from a speech signal using an SAP computed from posteriori Signal to Noise Ratios (SNR) calculated with regard to a $m^{th}$ frame of the speech signal and predicted SNRs predicted with regard to the $m^{th}$ frame, and indicating probability that speech is absent in the $m^{th}$ frame, the noise removing method comprising:

(f) obtaining the posterior SNRs of the speech signal by frame, (g) modifying pri SNRs and the posterior SNRs by using the SAP, the posterior SNRs, and previous SNRs and deciding the modified results as the modified pri SNRs and the modified posterior SNRs;

(h) obtaining a gain to be applied to each frequency channel by using the modified pri SNRs and the modified posterior SNRs;

(i) multiplying the speech signal and the gain;

(j) obtaining the previous SNRs by using estimated value of noise power and the result multiplied in step (i);

(k) obtaining the estimated values of the noise power and speech power by using the speech signal, the SAP and the predicted SNRs; and (l) obtaining the predicted SNRs by using the estimated values of the speech power and the noise power.

* * * * *